United States Patent [19]

Mihara

[11] 4,298,779

[45] Nov. 3, 1981

[54] ROTARY TYPE MICROSWITCH

[75] Inventor: Haruhiko Mihara, Tsu, Japan

[73] Assignee: Matsushita Electric Works, Ltd., Osaka, Japan

[21] Appl. No.: 110,102

[22] Filed: Jan. 7, 1980

[30] Foreign Application Priority Data

Jan. 13, 1979 [JP] Japan ..... 54/3122[U]
Jan. 13, 1979 [JP] Japan ..... 54/3123[U]
Jan. 13, 1979 [JP] Japan ..... 54/3261

[51] Int. Cl.[3] ..... H01H 3/04; H01H 5/04

[52] U.S. Cl. ..... 200/335; 200/153 T; 200/67 B; 200/330

[58] Field of Search ..... 200/329, 330, 331, 332, 200/335, 336, 337, 338, 340, 153 T, 153 G, 153 H, 67 R, 67 D, 67 B, 293, 303

[56] References Cited

U.S. PATENT DOCUMENTS

| | | | |
|---|---|---|---|
| 1,274,674 | 8/1918 | Brockett | 200/329 |
| 2,555,258 | 5/1951 | Walley | 200/303 |
| 2,805,299 | 9/1957 | Cherry, Jr. | 200/67 B |
| 2,867,700 | 1/1959 | Taylor | 200/303 |
| 3,480,752 | 11/1969 | Cherry et al. | 200/335 |

FOREIGN PATENT DOCUMENTS

| | | | |
|---|---|---|---|
| 954919 | 4/1964 | United Kingdom | 200/67 D |

*Primary Examiner*—John W. Shepperd

*Attorney, Agent, or Firm*—Burns, Doane, Swecker & Mathis

[57] ABSTRACT

A rotary type microswitch wherein a rotary handle member having at its body periphery a handle for driving a free end of a movable contact spring plate carrying a movable contact opposed to a stationary contact is rotatably borne at both axial ends between opposing side walls of a housing, and a lever member receiving an external operating force for rotating the handle member is coupled on a desired side of the housing to either one of the both ends of the handle member which are exposed to the exterior of the side walls. With the handle member thus providing a free selectivity in operating-force applying direction with respect to the both ends at which the member is borne, stably reliable switching operation is obtained. Such operation is further assured to be achieved with a smaller operating force due to the fact that a slidable card is inserted between the free end of the movable contact spring plate and the handle. A lever arm of the lever member has a bent end engaged in a receptive groove in a head part of the lever member disposed outside the housing so as to conform to the bent end. The lever includes a part transverse to the axis of the member and a part parallel to the axis. The engagement of the arm in the groove is locked by a cap easily fittable to the head part of the lever member but prevented from being easily detached.

5 Claims, 19 Drawing Figures

ROTARY TYPE MICROSWITCH

This invention relates to microswitches and, more particularly, to improvements in rotary type microswitches wherein an operating lever extending out of a switch body is rotated by an externally generated force to perform contact switchings.

Referring to a mounting arrangement for the operating lever to the switch body as generally used in conventional microswitches of the kind referred to with reference to FIG. 1, an operating lever 1' is provided adjacent an end of a rotary shaft 2' terminating within the switch body with a handle 3' which extends from the shaft at right angles thereto, and the shaft 2' in inserted through a bearing hole 6' provided in one side wall of a switch body case 4'. As shown in FIG. 2, the handle 3' is bought into contact at its extended end with the free end of a contact spring 7' carrying a movable contact of a contact mechanism opposite to at least one of same stationary contacts. Therefore, in response to the rotation of the lever 1' and shaft 2', the handle 3' rotates as shown by the dotted line in FIG. 2 to drive the spring 7' to open and close or switch over the contacts. In the arrangement wherein the rotary shaft 2' of the operating lever 1' is thus cantilevered as borne only by one side wall of the switch body, there are defects that, as the direction and side of applying a force to the operating lever 1' from outside are determined by the particular side of the switch body on which the lever is mounted thereto, it is necessary to prepare two kinds of the switches in each of which the operating lever is provided differently so as to allow either one of these two kinds to be selected depending on a desired force applying direction or side, and that, as the rotary shaft of the operating lever is held on one side, the shaft and bearing hole therefore are likely to be easily worn and no stable switching action for a long period can be expected.

Further, in the switches of the arrangement as described above, generally a straight extending or flat movable contact spring as seen in FIG. 2 is used and, in order to positively operate such spring, it is necessary to make the handle 3' long and its rotating stroke large and, accordingly, to provide the contacting part of the spring 7' with the handle to be long. As a result, there are defects that the force required for rotating the operating lever must be large, and that the handle and spring are likely to be worn at the parts of sliding contact with each other. In view of such defects, there has been suggested an arrangement in which, for example, the handle 3'' is made comparatively short as shown in FIG. 3 while the contact spring 7' is bent at the free end in a direction substantially at right angles with respect to the extending direction of the spring as shown by 7'' and engaged at this bent tip with the handle 3'', so that rotating stroke of the handle as well as required torque therefore can be made smaller. However, in this case, there arise other defects, e.g., that the contact spring requires an additional bending work, and that such contact spring bent at the free end cannot be used any more in common with push-button type switches in which the flat movable contact spring is generally used.

On the other hand, as a measure of rendering it possible to provide a large torque to the operating lever without modifying the shape of the handle and contact spring as well, it has been generally practiced, for example, to have an operating lever 1'' long extended from a rotary shaft 10' at right angles to the lengthwise direction thereof as fixed at one end of the lever to an end of the shaft projecting out of the switch body as shown in FIGS. 4 and 5, so as to have an external switch operating force exerted at the other extended end of this lever 1''. In such a case, various measures have been taken in order to perfectly and reliably fix the lever 1'' to the shaft 10'. In the illustrated case of FIGS. 4 and 5 of a typical example, a transverse groove 11' extending in the axial direction from the projected end surface of the shaft 10' is provided. The lever 1'' is inserted at a part adjacent its one end into this groove 11' and a substantially ring-shaped washer 12 having along its inner peripheral edge many projections 13' for preventing the washer from being pulled out of its engaging position is urged into an engagement with the periphery of the projected end of the shaft 10' by means of a tool so as to depress and fix the lever 1'' to the bottom of the groove 11'. Preferably, another member having a locking hole is fixed to the shaft, the lever 1'' is bent at the above referred one end, and such bent end of the lever is locked in this locking hole. However, even in this measure, there are involved further other defects in that it is complicated to mount and fix the lever 1'', and the washer is apt to be loosened by the force given to the lever 1'' (it is necessary, therefore, to couple them integral with the shaft by means of a binder after the fixation of them so as to render it stable, and the like). In order to eliminate these defects, as another measure, there has been suggested an arrangement wherein a lever mounting member formed of, for example, a synthetic resin is employed for mounting and fixing the lever in a simple manner before or after the member is fixed to the rotary shaft, but it has been still difficult in general to achieve a stable fixation since the member has been easily caused to slip away.

A primary object of the present invention is, therefore, to provide a rotary type microswitch wherein the operating force-applying-direction and the side of the switch body to which such force is applied are made freely selectable depending on operating conditions by means of a single set of constituent elements which are common to any of such directions and sides, and wherein a reliable and stable switching operation can be attained with a simpler arrangement.

Another object of the present invention is to provide a rotary type microswitch wherein the operating force applying direction and side can be freely selected in response to the using conditions and yet the possibility of common use of the contact mechanism in such other operating type microswitches as the push-button type can be maintained.

Still another object of the present invention is to provide a rotary microswitch wherein respective componential elements can be easily assembled without requiring any special jig, a reliable switching operation can be stably obtained for a long period and the position of fitting a rotary operating member to the switch body can be easily selected in response to the using conditions.

Other objects and advantages of the present invention shall become clear upon reading the following explanation of the present invention detailed with reference to preferred embodiments of the invention shown in the accompanying drawings, in which:

FIG. 3 is a partial elevation showing another example of the arrangement of the contact operating handle and contact spring in another example of the conventional switches of the kind referred to;

FIGS. 4 and 5 are respectively a plan view and side view showing an example of an arrangement of fixing the operating lever to the rotary shaft in the conventional switches of the kind referred to;

Figure 1:
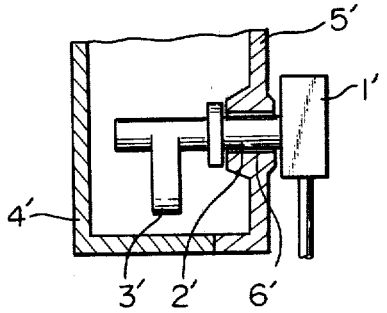
Fig. 1 PRIOR ART
FIG. 1 is a fragmentary sectioned view showing a general arrangement of operating lever in conventional rotary type microswitches.

While the present invention shall be described in detail in the followings with reference to the illustrated embodiments, it should be appreciated that the intention is not to limit the invention only to the particular embodiments but is to rather include all possible modifications, alterations and equivalent arrangements within the scope of appended claims.

Referring first to general arrangement of the rotary type microswitch according to the present invention with reference to FIGS. 6 to 10, a microswitch body 1 generally comprises a housing body 2 containing a contact mechanism and contact operating means, and a cover plate 3 fitted to the body 2. Terminals connected to movable and stationary contacts 13*c*, 11*a* and 12*a* of the contact mechanism are led out of the body 2. Also, a later described operating lever body of the contact operating means is positioned at its one end out of the body 2 or cover plate 3 (out of the cover plate 3 in the drawing) so as to be axially rotated by an operating force given externally to a lever arm mounted to the one end of the lever body to open and lose or reverse the contacts.

Figure 2:
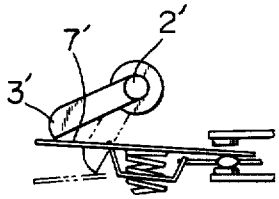
Fig. 2 PRIOR ART
FIG. 2 is a fragmentary elevation showing a contact relation between a contact operating handle and movable contact spring in the switch of FIG. 1.
Figure 3:
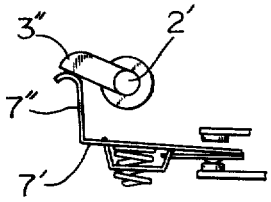
Fig. 3 PRIOR ART
Figure 4:
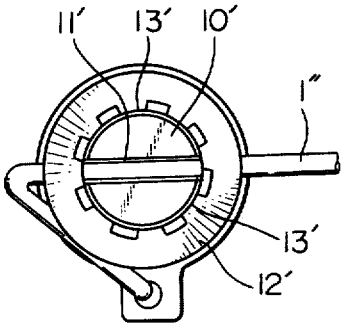
Fig. 4 PRIOR ART
Figure 5:
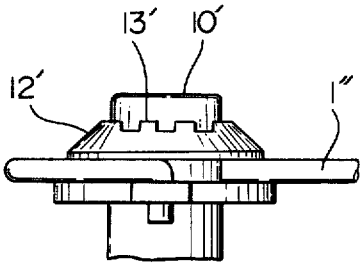
Fig. 5 PRIOR ART
Figure 6:
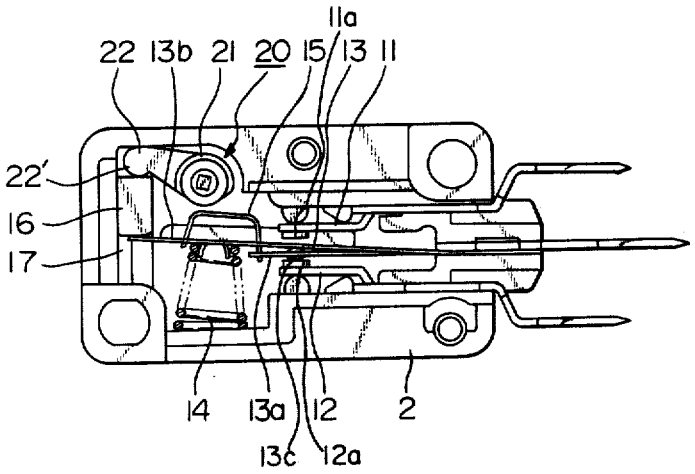
FIG. 6 is a magnified side view showing an internal arrangement in an embodiment of the rotary type microswitch according to the present invention with a cover plate forming one side wall and operating lever removed.
Figure 7:
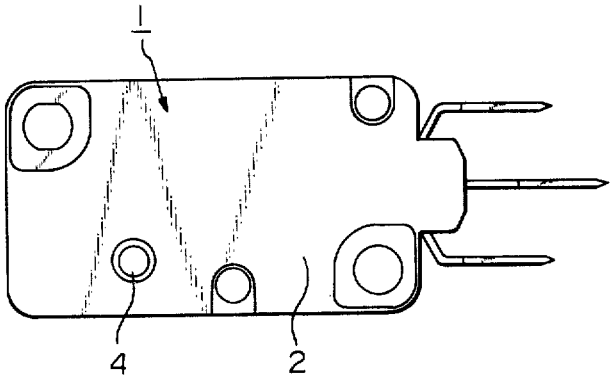
FIG. 7 is the other side view of the switch shown in FIG. 6.
Figure 8:
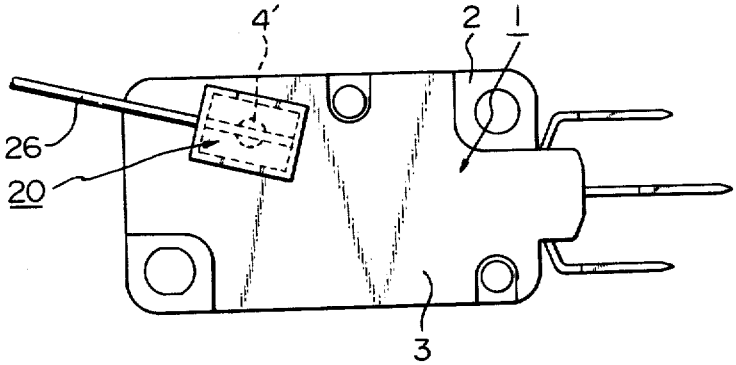
FIG. 8 is a side view showing the switch of FIG. 6 with the cover plate and operating lever mounted.
Figure 9:
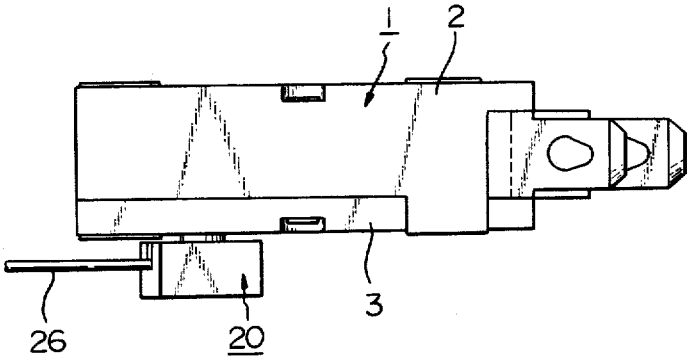
FIG. 9 is a plan view of the switch shown in FIG. 8.

The contact mechanism generally comprises, in the illustrated case, a pair of stationary contact plates 11 and 12 including their stationary contacts 1*a* and 12*a* respectively carried at one end of the plate and arranged to oppose each other inside the housing body 2, the other ends of which plates being led out of the body 2 as terminals. A movable contact spring plate 13 includes a first free end 13*a* carrying a movable contact 13*c* at a position between the repsective opposed stationary contacts 11*a* and 12*a* and a second free end 13*b* extended beyond the first free end 13*a*, a joined base part of which free ends 13*a* and 13*b* being connected to a movable contact terminal also led out of the housing body 2. A spring 14 biases the second free end 13*b* of the spring plate 13 to its normal non-operating position. A spring 15 is engaged between both of the free ends 13*a* and 13*b* of the spring plate 13 for turning the first free end 13*a* carrying the movable contact 13*c* when a force is given to the free end 13*b* to shift it to an operating position against the force of the spring 14. Further, the contact operating means for the contact mechanism comprises a sliding member 16 of an electrically insulative material, which is slidably supported within a guide groove 17 provided in the housing body 2 at right angles with respect to the extending direction of the spring plate 13 and engaged with the extended second free end 13*b*, and an operating lever assembly 20 which is axially rotatably borne between opposed bearing holes 4 and 4' of the housing body 2 and cover plate 3 with a later described arrangement so as to transmit the externally given operating force to the extended free end 13*b* of the movable contact spring through the sliding member 16 to shift the first free end 13*b* to the operating position. In this case, the spring plate 13 carrying the movable contact 13*c* may be of a formation common with that of a movable contact 13*c* spring plate used in the so-called push-button type microswitch in which the same operating force as that given through the operating lever assembly 20 and sliding member 16 to the extended free end 13*b* is given by a push button. Therefore, it has normally a flat side elevation as shown in FIG. 6 but, in case such common formation is not required, a type in which the movable contact spring plate is bent at the extended tip and brought into direct engagement with the operating lever assembly 20 as shown, for example, in FIG. 3 or a type in which the movable contact spring plate is contacted at the flat free end directly with the handle of the operating lever assembly as shown in FIG. 2 may be adopted.

Figure 10:
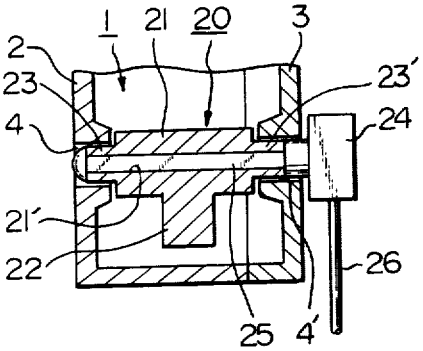
FIG. 10 is a magnified fragmentary section showing the arrangement of mounting an operating lever assembly according to the present invention in the embodiment of FIG. 6.
Figure 11:
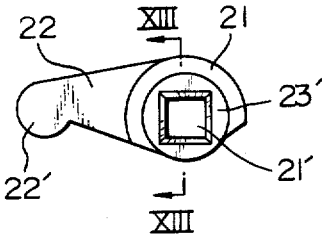
FIG. 11 is an endwise elevation of a handle member in the operating lever assembly of the present invention shown in FIG. 10.
Figure 12:
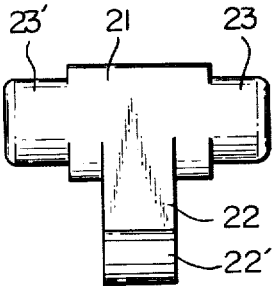
FIG. 12 is a plan view of the handle member shown in FIG. 11.
Figure 13:
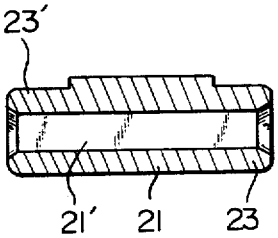
FIG. 13 is a sectioned view along line XIII—XIII in FIG. 11 of the handle member.
Figure 14:
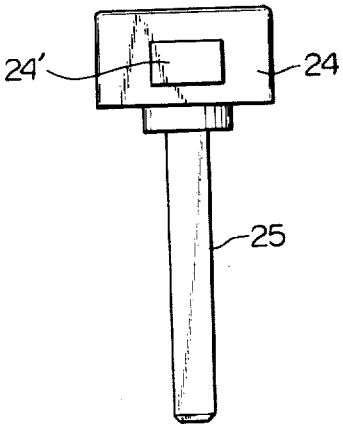
FIG. 14 is a plan view of an operating lever body of an embodiment according to the present invention of the operating lever assembly shown in FIG. 10.
Figure 15:
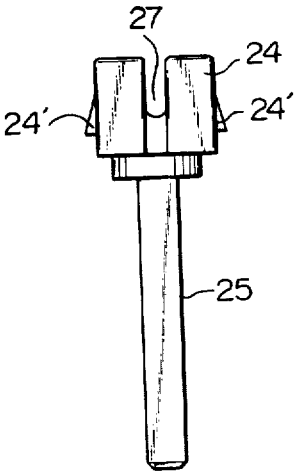
FIG. 15 is a side view of the operating lever body shown in FIG. 14.
Figure 16:
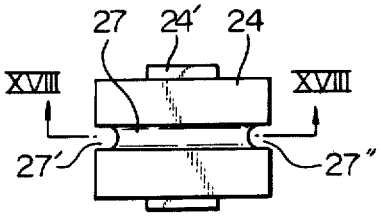
FIG. 16 is a top view of the operating lever body of FIGS. 14 and 15.
Figure 18:
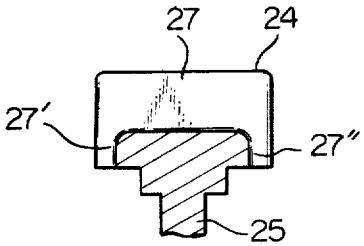
FIG. 18 is a fragmentary sectioned view taken along line XVIII—XVIII in FIG. 16 at the head portion of the operating lever body.
Figure 17:
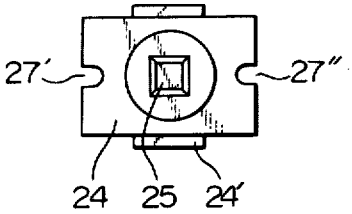
FIG. 17 is a bottom view of the operating lever body of FIG. 16.
Figure 19:
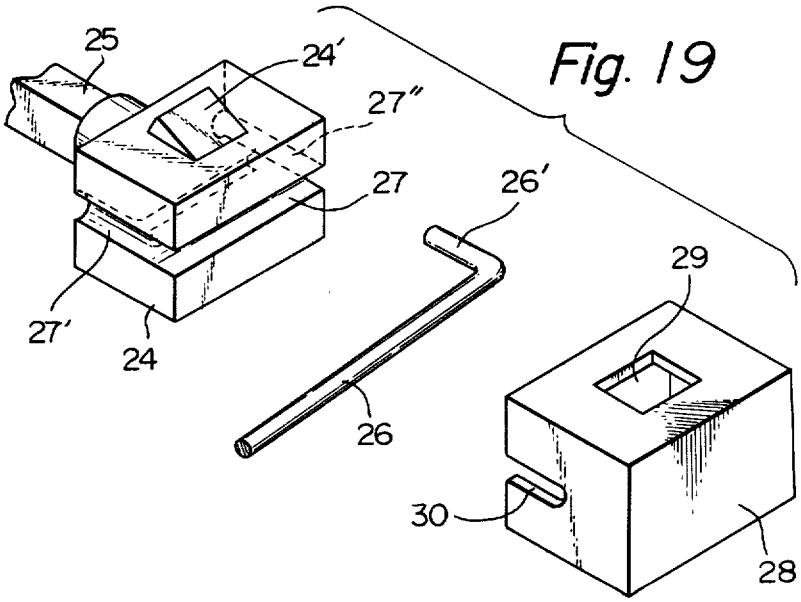
FIG. 19 is an exploded prespective view of the operating lever main body shown in FIGS. 14 to 18 and a lever arm and locking cap for the arm respectively to be assembled with the operating lever body.

The operating lever assembly 20 comprises a handle member 21 provided, as shown in FIGS. 11 to 13, with a handle or arm 22 extending from a substantially cylindrical body of the member in a direction prependicular to the longitudinal axis of the member. Shaft portions 23 and 23' are provided at both longitudinal ends of the handle body. An axial shaft hole 21' square in section over the entire axial length in this case, is provided in the body. An operating lever body 24 is mounted on the handle body and is provided, generally as shown in FIGS. 14 to 18, with a shaft bar 25 of a square cross-section to be inserted intimately into the shaft hole 21' of the handle member 21. A lever arm 26 extends out of the switch body at right angles with respect to the longitudinal direction of the shaft bar 25. As shown in FIG. 10, the contact mechanism is inserted into the housing body 2 in the above described relation to the sliding member 16 as shown in FIG. 6, and then the handle 22 is engaged at its tip 22' with the sliding member 16, which tip has a circular peripheral surface. The handle member 21 is inserted such that shaft portion 23 extends into the bearing hole 4 of the housing body 2. The cover plate 3 is fitted to the housing body 2 to cover the above described arrangement while having the other shaft portion 23' of the handle member 21 engaged into the bearing hole 4'. At this time, both end surfaces of the handle member 21 thus rotatably borne at the shaft portions 23 and 23' inside the switch body are exposed to the exterior of the housing body 2 and cover plate 3 so as to allow both end openings of the axial shaft hole 21' to be easily accessible on both sides of the switch body. Then the shaft bar 25 of the operating lever body 24 is inserted into the shaft hole 21' of the handle member 21 from either side of the housing body 2 and cover plate 3 (in the drawing, from the side of the cover plate 3). At this time, the shaft bar 25 of the body 24 is so inserted into the shaft hole 21' that the lever arm 26 of the operating lever body will extend in the extending direction of the movable contact spring plate 13 or in a direction properly selected in relation to a surface of another device or the like to which the switch body 1 is installed. In the illustrated case of FIG. 10, the shaft bar 25 of the operating lever body 24 has a length enough for projecting at its tip end to some extent out of the end surface of the handle member 21 over the entire length of the member 21, so that the lever body 24 and handle member 21 can be integrally joined by mechanically or thermally calking the projected tip end of the shaft bar 25 to be coupled to the end surface of the member 21. This integration determines the using condition as to the direction or side of applying the external rotary operating force to the operating lever. In case this integration is made at the final step of manufacturing the microswitch, proper numbers of respective proper numbers of products with different using direction or side thus already determined depending on expected using conditions and their ordered numbers. However, the integrtion of the lever body 24 and handle member 21 may not be made by such calking in the final step but may be made in such proper manner that, after their assembly, the lever body 24 will be removable from the handle member 21 so as to be again inserted from another desired side or that, after the lever body 24 is thus inserted again, the calking or, if either or both of the members 21 and 24 is made of a synthetic resin, a thermofusing is performed. Alternatively, the respective end surfaces of the member 21 and bar 25 may be joined by means of an adhesive agent, or the tipe end of the shaft bar 25 may be preliminarily split in its longitudinal direction, preferably providing a lateral flange or projections, so that the shaft bar 25 may be allowed to be inserted into the shaft hole 21' from the split tip with the flange or projections resiliently bowed during the insertion but engaged to the end surface of the member 21 so as to prohibit reverse directional movement of the shaft bar 25.

A coupling arrangement of the lever arm 26 to the operating lever body 24 lever arm 26 shall be explained next with reference to FIGS. 14 to 19. The lever body 24' which is positioned as projected out of the switch body 1 on either selected side thereof when the body 24 is assembled with the handle member 21' is formed integrally with the shaft bar 25 preferably with a synthetic resin. The lever body 24 is made substantially in a parallelepiped shape of which the longitudinal axis extends in the direction perpendicular to the longitudinal direction of the shaft bar 25. The lever arm 26' formed substantially in an L-shape preferably with a metal wire, is combined with the body 24 at a short bent end 26' so as to extend at the other end in the longitudinal direction of the parallelepiped. In order that the coupling between them will be made reliable and the operating force applied to the extended end of the arm 26 can be reliably converted to the axial rotation of the shaft bar 25, the operating lever body 24 is provided in its projected end surface with a groove 27 lying in the longitudinal direction referred to in the above and cut substantially to the center part of the parallelepiped body in the axial direction of the shaft bar 25. The groove 27 is made continuous at both ends in the lengthwise direction of the body 24 to bent grooves 27' and 27'' extending to the side opposite the projected end surface along both end surfaces of the parallelepiped. The L-shaped lever arm 26 is inserted in the groove 27 so as to intersect at right angles the axial line of the shaft bar 25 with its main long leg directed in the desired direction and with the bent end 26' inserted in the bent groove 27' or 27''. Here, the arm may be fixed in the groove by means of an adhesive or the like poured into the grooves 27 and 27' or 27'' but, as a preferable form according to the present invention, the arm is fixed to the body 24 by means of a cap 28 made preferably of a relatively soft synthetic resin and having a shape and dimensions conformable to the outer surfaces of the parallelepiped of the lever body 24. The cap 28 is formed, therefore, in the form of a box opened on one surface and having a groove 30 which is of a width enough for receiving the arm 26 and cut from the opened end edge substantially over to the center of a longitudinal end wall facing the bent groove 27' or 27'' of the body 24. Therefore, when the cap 28 is fitted to the body 24, the lever arm 26 will project out of the groove 30 and will be urged against the bottom of the groove 27 by a bottom edge of the groove 30. In order that the cap 28 thus fitted to the body will be stably held to the fitted position without requiring any adhesive or the like, the body 24 is provided preferably in its respective opposing side surfaces parallel to the groove 27 with a tapered projection 24' expanding gradually in the extending direction of the shaft bar 25 from the projected end side of the body 24 and the cap 28 is provided on the respective side wall facing the opposing side surfaces of the body 24 with an opening or recess 29 which allows the tapered projection 24 to be engaged therein. Therefore, when the cap 28 is fitted to the lever body with edges defining the opening or recess 29 elastically deformed to allow the projections 24' engaged into the opening 29, these edges of the cap will engage with projected end edges of the projections 24' as the cap's edges return to their original form, whereby the cap 28 will be held in the fitted position without being easily dismounted from the lever body 24. If the groove 30 is provided in a pair in both of the longitudinal end walls of the cap, the direction in which the cap is fitted to the lever body 24 will not be limited.

The operation of the rotary type microswitch according to the present invention having the above described arrangement shall now set forth. An external force give to the extended end of the lever arm 26 out of the switch body 1 in a direction substantially perpendicular to the lever's extending direction will be transmitted to the shaft bar 25 as a torque acting about its axis through the operating lever body 24. Thus the shaft bar 25 will be axially rotated with the shaft portions. 23 and 23' of the handle member 21 as axes. The handle 22 will be rotated with it, whereby the sliding member 16 with which the handle 22 is in contact at the tip 22' will slide along the guide groove 17 against the biasing force of the spring 14 transmitted through the extended free end **13*b* of the movable contact spring plate 13. The extended end 13*b* of the spring plate 13 will be shifted from the non-operating position shown in FIG. 6 to the operating position, downward in the drawing. With this movement, the free end 13*a* carrying the movable contact 13*c* and linked with the extended free end 13*b* through the spring 15 will be caused to shift in the direction reverse to that of the end 13*b* due to a snapping action of the spring 15. The movable contact 13*c* will be turned from a stationary contact 12*a* with which the extended end 13*b* is in contact in the non-operating position to the other stationary contact 11*a*. In this case, the turning of the movable contact 13*c* may be of the one for opening normally closed contacts or vice versa. When the handle arm 26 is released from the external force, the spring 14 causes the extended free end 13*b* of the spring plate 13 to return to the original position, whereby the free end 13*a* carrying the movable contact 13*c* will be returned to the original position through the spring 15, while the extended free end 13*b* will push the sliding member 16 so that the handle 22 or operating lever assembly 20** will be also rotated in the reverse direction to return to the original position.

It should be specifically noted in the above described operation that, according the present invention, the axial rotation of the operating lever assembly 20 is attained with the respective shaft portions 23 and 23' of the both ends of the handle member 21 borne in both side walls of the microswitch body 1. This will result in such remarkable advantages that the rotary shaft members 21 and 25 borne at both ends can perform the rotation in a more stable manner than the rotation in the case of the conventional cantilever type bearing only on one side, that the external force can be transmitted to the operating lever assembly on either side of these both end shaft portions 23 and 23' so that the arrangement allowing the freely selectable direction or side of applying the external operating force can be obtained with the same parts of the microswitch, and at the same time that the wear in the rotary shaft bearing part will be remarkably reduced and a reliable switching operations can be maintained stably for a long period.

The above described advantages are obtained by such simple arrangement requiring only a simple assembling work as above, according to which the handle member 21 acting as the rotary shaft is simply prepared to be of a length capable of bridging across the both side walls of the microswitch body and rotatably borne in advance between the both side walls while the shaft bar 25 of the operating lever body 24 is assembled with this member 21 from the exterior of the switch body on a desired side thereof next, and, therefore, the direction and side of applying the external force can be freely selected without causing any particular disadvantage as compared with the assembly of the conventional switches of the kind referred to.

In connection with the above described advantages, further, there are such advantages that, as the movable contact is operated by the rotation of the operating lever body 24 through the sliding member 16 of the kind generally referred to as a card, the ability of the movable contact carrying spring member or the entire contact mechanism being commonly used in both the push-botton type and rotary type microswitches can be effectively maintained without particularly complicating the formations of the respective parts, and that with the handle of the operating lever made smaller the contact switching operation can be attained reliably and smoothly even with a small torque.

Further related advantages obtainable according to the present invention are that, as the above referred arrangement achieving the foregoing advantages is combined with the feature that the coupling of the lever arm to the operating lever body is achieved by engaging the bent end of the arm into the groove provided in the longitudinal direction of the lever body and its continuous bent groove, and with the further feature of the arrangement of fixing the arm to the body by using the cap which can be simply fitted to the coupling part of the thus engaged lever body and arm, not only these parts can be easily coupled together without requiring any special jig but also this coupling can be made reliable and stable, whereby the reliable and stable operation of the contact mechanism can be further assured and promoted.

What is claimed is:

1. In a rotary type microswitch wherein a movable contact carrier carries a movable contact opposed to at least one stationary contact and is displaced between its normal non-operating position and an operating position in response to an external force to change the contacting state of said movable contact relative to said stationary contact, the combination comprising a housing having two side walls provided at mutually opposing and axially aligned positions with a pair of shaft bearing holes respectively communicating the interior of the housing with the exterior, a handle member rotatably mounted in said bearing holes and including an arm extending generally laterally from an axis of rotation of said handle member and operably engaged with said movable contact carrier to displace the latter, said handle member including a hole extending axially therethrough and being open at both ends such that both ends are accessible from the exterior through said bearing holes, a shaft bar extending axially in said axial hole and being non-rotatable relative to said handle member, a lever arm disposed exteriorly of said housing and coupled to one end of said bar through a respective bearing hole, said lever arm extending laterally of said axis to rotate said handle member and displace said movable contact carrier in response to an external force, the opposite end of said bar reaching the associated end of said handle member and being integrally fixed thereto.

2. A microswitch according to claim 1 wherein said axial hole of the handle member is of a square cross-section, and said shaft bar of the lever member is of a square cross-section engageable in said square cross-sectional axial hole of the handle member.

3. A microswitch according to claim 1 wherein said movable contact carrier includes a first free end carrying said movable contact and a second free end extending over said first free end to a position substantially adjacent a longitudinal end wall of said housing, and resiliently biased normally to said non-operating position of the carrier, and said arm of the handle member is connected to said second free end through a sliding member engaged with the second free end and slidable between two positions corresponding to the non-operating position and said operating position substantially along said end wall of the housing.

4. A microswitch according to claim 1 including a lever member connecting said lever arm to said shaft bar, said lever member comprising a body having a parallelepiped outline, means provided on one of longitudinal side surfaces of said parallelepiped body for coupling the body to said one end of said handle member, a groove provided in the other longitudinal said surface opposite to said side surface to extend in the longitudinal direction of the body and contiguous to bent groove made along at least an end surface in the longitudinal direction of the body, and a cap member fitted to said parallelepiped body for retaining said lever arm within said grooves, said lever arm having at one end a bent portion engaged in said bent groove and a main body portion engaged in said groove.

5. A microswitch according to claim 1 wherein said movable contact carrier is provided with a first free end carrying said movable contact, a second free end operated by said arm of said handle member, and a turning spring disposed between said first and second free ends so as to operate the first free end responsive to said operation of the second free end to engage and disengage the movable contact with said stationary contact.

* * * * *